US007828625B2

(12) United States Patent
Yu et al.

(10) Patent No.: US 7,828,625 B2
(45) Date of Patent: Nov. 9, 2010

(54) METHOD OF SUPPLYING POLISHING LIQUID

(75) Inventors: Chi-Min Yu, Hsinchu (TW); Chi-Chih Chuang, Hsinchu (TW); Hui-Shen Shih, Changhua Hsien (TW)

(73) Assignee: United Microelectronics Corp., Hsinchu (TW)

( * ) Notice: Subject to any disclaimer, the term of this patent is extended or adjusted under 35 U.S.C. 154(b) by 37 days.

(21) Appl. No.: 11/928,155

(22) Filed: Oct. 30, 2007

(65) Prior Publication Data

US 2009/0111361 A1 Apr. 30, 2009

(51) Int. Cl.
*B24B 1/00* (2006.01)

(52) U.S. Cl. ..... 451/5; 451/41; 451/51; 451/60

(58) Field of Classification Search ..... 451/5, 451/8, 41, 56, 60
See application file for complete search history.

(56) References Cited

U.S. PATENT DOCUMENTS

| | | | | |
|---|---|---|---|---|
| 4,672,705 | A * | 6/1987 | Bors et al. | 8/151 |
| 5,551,986 | A | 9/1996 | Jain | |
| 5,593,342 | A * | 1/1997 | Thibaut | 451/159 |
| 6,051,499 | A * | 4/2000 | Tolles et al. | 438/692 |
| 6,280,297 | B1 * | 8/2001 | Tolles et al. | 451/41 |
| 6,319,099 | B1 * | 11/2001 | Tanoue et al. | 451/60 |
| 6,547,652 | B1 * | 4/2003 | Roy | 451/285 |
| 6,769,959 | B2 * | 8/2004 | Chen et al. | 451/8 |
| 6,953,391 | B1 * | 10/2005 | Majumder et al. | 451/60 |
| 7,141,502 | B1 | 11/2006 | Xie et al. | |
| 2003/0143924 | A1 * | 7/2003 | Chen et al. | 451/5 |

* cited by examiner

*Primary Examiner*—Maurina Rachuba
(74) *Attorney, Agent, or Firm*—J.C. Patents

(57) ABSTRACT

The present invention relates to a method of supplying the polishing liquid by periodically interrupt the supply of the polishing liquid, thus avoid over-supply or wastage of the polishing liquid. Hence, the consumption of the polishing liquid can be decreased and the production cost can be lower.

14 Claims, 4 Drawing Sheets

METHOD OF SUPPLYING POLISHING LIQUID

BACKGROUND OF THE INVENTION

1. Field of the Invention

The present invention relates to a chemical mechanical polishing process. More particularly, the present invention relates to a method of supplying the polishing liquid for the chemical mechanical polishing process.

2. Background of the Invention

Among the very-large-scale-integration (VLSI) or ultra-large-scale-integration (ULSI) manufacturing processes, global planarization can only be achieved by the chemical mechanical polishing (CMP) process. Basically, CMP employs similar concepts of the grinding wheels in conjunction with chemical substances to planarize and flatten the uneven surfaces of the deposited layers over the wafer. Planarization is one of the key factors for achieving high-quality alignment accuracy. If the planarization process goes wrong, it will cause difficulties in focusing for the subsequent photolithographic processes and the misalignment rates may considerably increase.

In addition to the global planarization of the wafer, CMP processes can be applied to fabricate the damascene structures for the vertical or horizontal metal interconnects, the shallow trench isolation structures and to planarize other advanced devices. Furthermore, the planarization process is indispensable for the manufacture of the multi-level metal interconnects.

FIG. 1 is a schematic view of the conventional polishing equipment. The core elements of the equipment 100 are an automated rotating platen 102 and a wafer holder 104. In general, the platen 102 is designed to be a round platen for the convenience of rotation with a polishing pad 106 arranged on the platen 102. A provided wafer 110 is hold by the wafer holder 104 and the position of the wafer holder 104 is adjustable. The wafer holder 104 can both exert force on the wafer 110 and rotate the wafer 110 independent of the rotation of the platen 102. During polishing, the wafer holder 104 ensures the wafer 110 touching the polishing pad 106. A polishing liquid supply 108 is disposed above the platen 102 and provides a polishing liquid 112 for polishing. Polishing of the wafer 110 is accomplished through the polishing pad 106 and the polishing liquid 112. A dresser 114 is usually incorporated in the equipment 100 for conditioning the polishing pad 106.

The choices for different types of the polishing pads or the alterations of the slurry recipes in the polishing processes usually have great impacts on the polishing performance. For the CMP processes, because the used polishing liquid often causes pollution to the environments and needs to be recycled, it is necessary to carefully evaluate the way of using the polishing liquid and the required amount of the polishing liquid.

SUMMARY OF THE INVENTION

The present invention provides a polishing liquid supply method by periodically interrupting the supply of the polishing liquid to the polishing pad, namely, supplying the polishing liquid in the intermittent way. Hence, the consumption of the polishing liquid becomes less and the wastage or overflow of the polishing liquid can be minimized, thus providing stable and uniform chemical mechanical polishing.

The present invention also provides a method of supplying a polishing liquid. The method comprises at least the steps to (a) provide a wafer having a material layer thereon; (b) perform a polishing process to the material layer of the wafer by providing at least a polishing liquid and polishing for a first period T1, wherein the material layer is in contact with a polishing pad on a platen for polishing; (c) stop supplying the polishing liquid and keep polishing for a second period T2; (d) provide the polishing liquid and keep polishing for a third period T3; and (e) repeat the steps of (c) to (d) until reaching an polishing endpoint of the CMP process, wherein a duration of the whole polishing process is T0, T0=T1+n×(T2+T3), and n represents a total number of repeating the steps of (c) to (d), n is an integer larger than 0.

According to the preferred embodiment of the present invention, T1 is at least larger than 40% of T0. Preferably, T1 is about 50% of T0, and T0 is between about 1~200 seconds.

According to the preferred embodiment of the present invention, T2 is about 0.5% of T0 to about 7.5% of T0. Preferably, T2 is about 1%, 2% or 3% of T0.

According to the preferred embodiment of the present invention, the material layer comprises at least a metal layer, a dielectric layer or a combination thereof.

According to the preferred embodiment of the present invention, T2 is positively correlated to the remained life time of the polishing pad.

According to another embodiment of this invention, the method further comprising using a dresser to condition the polishing pad during the steps of (b) to (d). T2 is positively correlated to the remained life time of the dresser.

According to the preferred embodiment of the present invention, T2 is adjustable by on-line monitoring in real time.

According to the preferred embodiment of the present invention, the platen has a centripetal acceleration larger or equal to about 20 ft/sec$^2$.

The supply method of the present invention can periodically cease the supply of the polishing liquid, and the ceased period or cycle can be adjusted depending on the requirements of the fabrication processes or environments. Therefore, the wastage of the polishing liquid can be reduced and the production costs can be cheaper.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

In the drawings.

FIG. 2A displays a process flow chart of the supply method according to a preferred embodiment of the present invention, while

DESCRIPTION OF THE PREFERRED EMBODIMENTS

Figure 1:
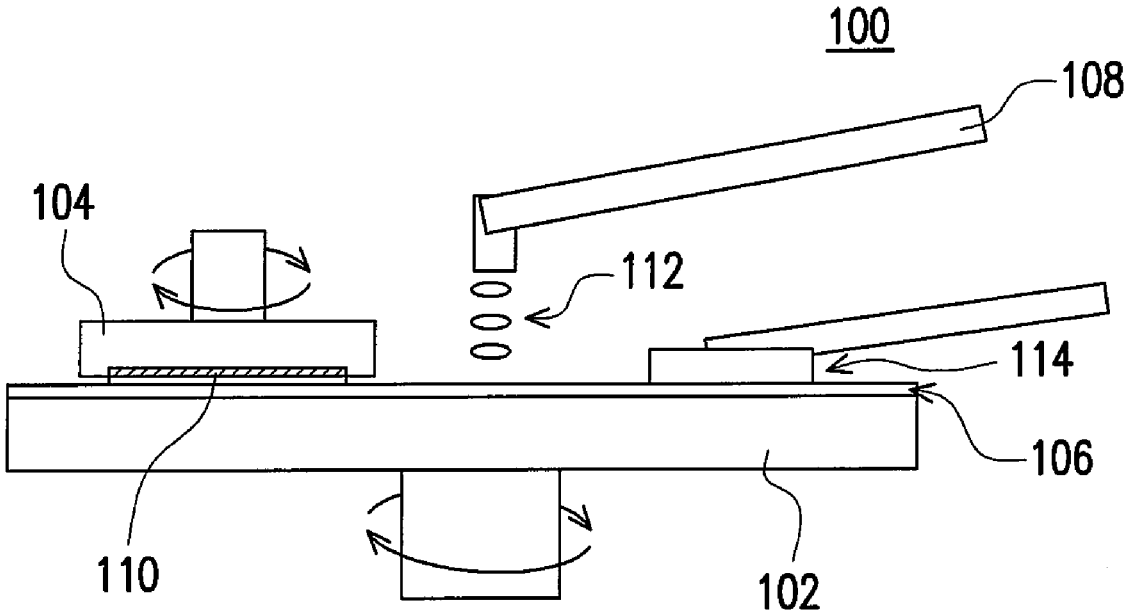
FIG. 1 (PRIOR ART)
FIG. 1 is a schematic side view of the conventional polishing equipment.
Figure 2A:
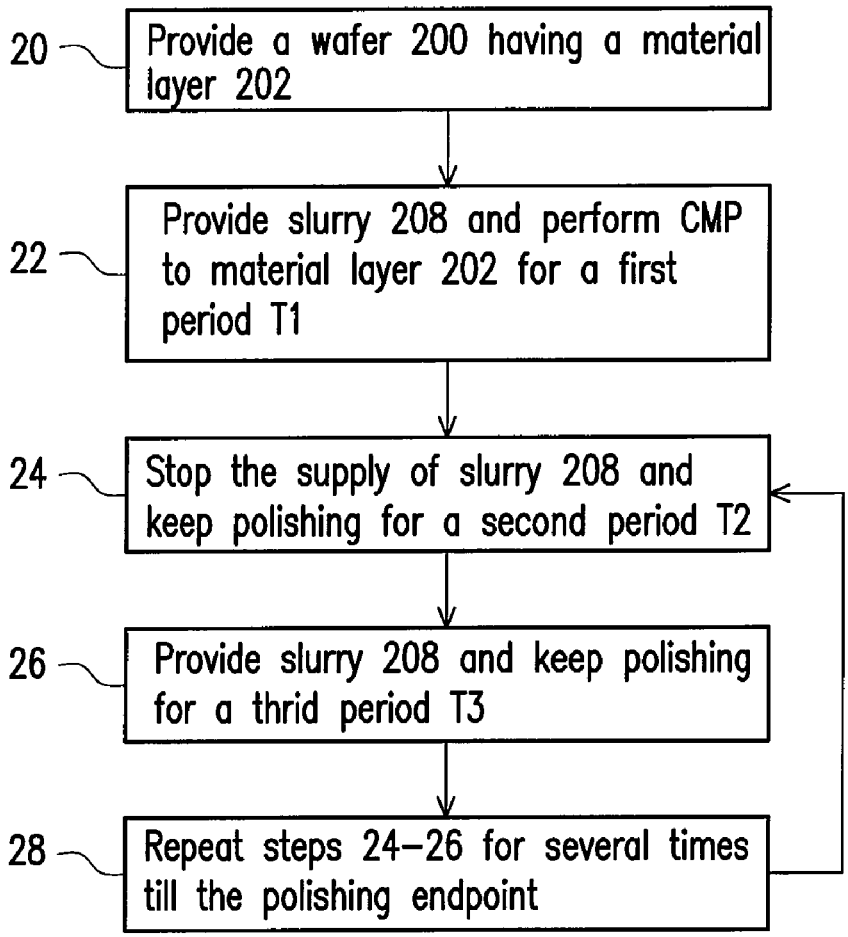
Figure 2B:
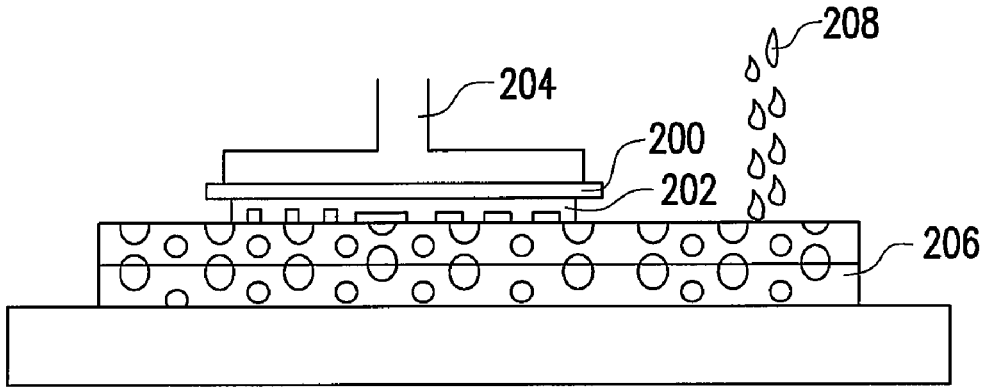
FIG. 2B is a cross-sectional display view of the process according to a preferred embodiment of the present invention.

FIG. 2A displays a process flow chart of the polishing liquid supply method according to a preferred embodiment of the present invention, while FIG. 2B is a cross-sectional display view of the polishing process according to a preferred embodiment of the present invention. Referring to FIGS. 2A and 2B, a wafer or substrate 200 having a material layer 202 is provided in the step 20. The material layer 202 can include at least a metal layer, a dielectric layer or a combination thereof, for example. The wafer or substrate 200 can be a semiconductor wafer, such as, a silicon wafer, a silicon germanium wafer or a silicon-on-insulator (SOI) wafer, or a non-semiconductor substrate, such as a glass substrate or a composite material substrate, for example. In the step 22, at least a polishing liquid 208 is provided, for a polishing process, to polish the material layer 202, and polishing lasts for a first period T1. For example, the polishing liquid 208 can be a polishing slurry comprising abrasive particles for a metal layer or a dielectric layer, or de-ionized water. The polishing process may be a chemical mechanical polishing process, a mechanical polishing process or an electro-chemical mechanical polishing process, for example. During polishing, the wafer holder 204 ensures the material layer 202 of the wafer 200 in contact with the polishing pad 206, and the polishing pad 206 and the liquid 208 act together to perform polishing to the material layer 202. In the following step 24, the supply of the liquid 208 is ceased but keeps polishing the material layer 202, and polishing lasts for a second period T2. Subsequently, in the step 26, the supply of the liquid 208 is restored or resumed, and keeps polishing for a third period T3. Afterwards, in the step 28, repeat the steps of 24-26 for a few times until the polishing endpoint is reached or the desired effect (e.g. desired thickness of the material layer) is achieved.

Moreover, the polishing process can be in time mode or endpoint mode, for example. For the polishing process in time mode, the required polishing time for the whole process or a certain part of the polishing process is specified or set in advance. For the polishing process in endpoint mode, the endpoint is obtained by measuring the thickness of the material layer with the detector of the polishing pad and over-polishing is performed for a while after reaching the endpoint.

If considering the time required for the whole CMP process toward the material layer 202 as T0, the relation between T0 and the first, second, third periods T1, T2, T3 should be:

T0=T1+n×(T2+T3), wherein n represents the number of the repeated times of steps 24-26, and n is an integer larger than 0.

T1 is at least larger than 10% of T0. Preferably, T1 is about 50% of T0, for wetting the polishing pad and avoiding dry polishing. T2 is about 0.5%~7.5% of T0. The process steps and the cited ratios or ranges are merely examples according to the preferred embodiments, and the scope of the present invention should not be limited by these examples mentioned herein.

If T2 is 1% T0, n=4, T3 is 11% T0, and T1 is 52% T0, for example.

If T2 is 2% T0, n=3, T3 is 15% T0, and T1 is 49% T0, for example.

If T2 is 3% T0, n=3, T3 is 14% T0, and T1 is 49% T0, for example.

If T2 is 4% T0, n=3, T3 is 12% T0, and T1 is 52% T0, for example.

If T2 is 5% T0, n=3, T3 is 12% T0, and T1 is 49% T0, for example.

Based on the experimental results, considering T2 being zero as the control (namely, the supply of the polishing liquid is constant and non-stopped), the comparison between the CMP processes using T2 being 2%, 3% or 5% T0 and the control indicates comparable or even better results regarding the removal rate of the material layer, non-uniformity and defect counts. Even when evaluating the center to edge index, the CMP results using T2 being 2%, 3% or 5% of T0 are acceptable.

In addition, if evaluated the existing compatible processes under the conditions of T2 being 2%, 3% or 5% T0, the average polishing cost for each wafer can be 12%, 18% or 30% less by using less polishing liquid. Overall, it can save up to several millions every year if applied in the current polishing processes.

In general, for the specific material layer, one can calculate how much time is required for the whole polishing process (i.e. T0) by measuring the pre-polish and post-polish thickness ex-situ, calculating the polishing rate from the difference between the pre-polish and post-polish thickness along with the polishing pad and the polishing liquid utilized in the process, and further determining the range of T0 based on the pre-polish thickness and the polishing rate. The polishing pad used in the present invention can be fixed abrasive (FA) pad or polishing pads with various patterns or grooves, for example. Of course, other factors that may affect the polishing process, including the exerted pressure (or force) by the wafer holder, the rotation speed of the wafer or the polishing pad (or platen), have to be considered, in order to adjust the range of T0. For example, T0 is about between 1~200 seconds.

The range of T2 should be adjusted according to the conditions of the polishing pad or the dresser. Furthermore, T2 can be fine-tuned either in real time or based on the conditions or the process requirements of wafers in the previous batch.

When determining the range of T2, many factors needs to be considered or carefully evaluated. Taking the polishing pad as an example, T2 is positively correlated to the remaining life of the polishing pad. During the beginning of using the polishing pad, the conditions of the pad surface are pretty good and the removal rate is high; in this case, the period of ceasing the polishing liquid supply can be longer (i.e. using larger T2) so as to economize the usage of polishing liquid.

The rough surface of the polishing pad is favorable for increasing the material removal rate, and proper conditioning by using the dresser can boost the pad surface roughness and improve removal uniformity. Similarly, taking the dresser as an example, T2 is positively correlated to the remaining life of the dresser. During the beginning of using the dresser, the conditions of the pad surface are pretty good and the removal rate is high; in this case, the period of ceasing the polishing liquid supply can be longer (i.e. using larger T2) so as to economize the usage of polishing liquid. Additionally, T2 is also inversely related to the conditioning ratio (the ratio of the conditioning time relative to the whole process). For example, the usage of the dresser can be synchronized with the supply of the polishing liquid.

The polishing efficiencies are critically determined by the surface conditions of the polishing pad. The supply method of this invention also comprises monitoring the surface conditions of the polishing pad in real time and adjusting T2 based on the feedbacks or monitored results immediately. For example, a detector is disposed in the polishing liquid supply system (or on the supply arm) or by the platen to monitor the surface conditions in real time during the polishing process. For the wafers going through polishing processes in batches, T2 can be modified according to the surface conditions estimated from the tested results of the polished wafers in the previous batch.

Moreover, other factors that may affect the polishing process, including the exerted pressure (or force) by the wafer holder, the centripetal acceleration of the wafer or the platen (or polishing pad), have to be considered for the best polishing performance. For example, the centripetal acceleration of the round platen can be at least equal to or larger than 20 ft/sec$^2$.

The supply method of this invention may further includes the steps of advanced process control (APC) by inputting the related process parameters to the control platform, calculating these parameters based on different priority or formula, determining the ranges of T0, T1, T2 or T3 according to the calculation results and specifying the polishing recipes for the specific polishing platform. The process parameters may include, for example, T0 related parameters (such as, pre-polish thickness of the material layer, the type or conditions of the polishing pad), T1 related parameters (such as, idling time of the polishing platform or the idling time between various batches) and T2 related parameters (such as, the remained life time of the polishing pad or dresser).

Figure 3A:
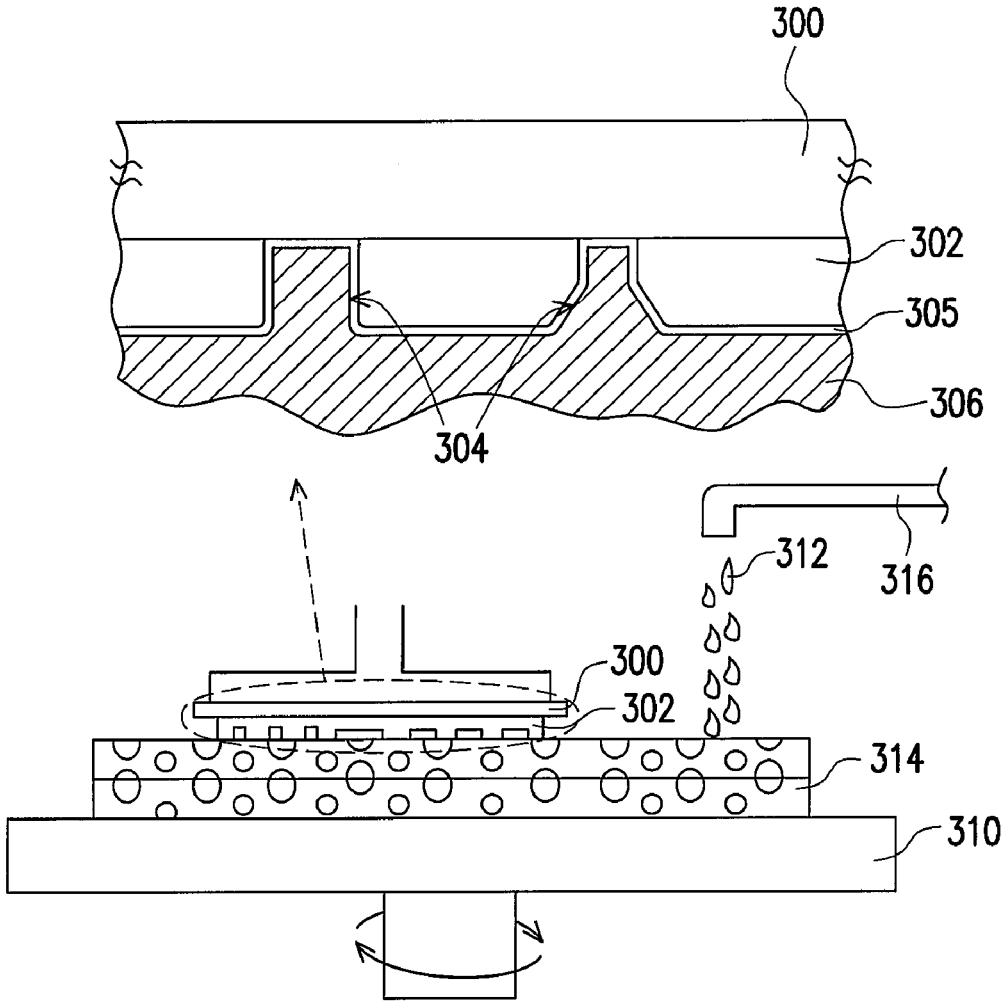
FIGS. 3A-3E are cross-sectional display views of the fabrication process of a metal interconnect structure according to a preferred embodiment of the present invention.

FIGS. 3A-3E are cross-sectional display views of the fabrication process of a metal interconnect structure according to a preferred embodiment of the present invention. Referring to FIG. 3A, a substrate 300 is provided to a polishing platen 310. As the enlarged proportional view, a dielectric layer 302 having at least an opening 34 is disposed on the substrate 300, and a conductive layer 306 is formed to cover the dielectric layer and fill up the opening 304. The conductive layer can be a metal layer, of a material such as copper or tungsten, for example. Before forming the conductive layer 306, a barrier layer 305 can be formed, conformally covering the surface of the opening 304, for example. The polishing platen 310 comprises a polishing liquid supply system 316 that provides at least a polishing liquid 312 to the polishing pad 314. For the convenience of descriptions, the following processes only display the partially enlarged view of the substrate portion and the display views have been rotated 180 degrees.

Figure 3B:
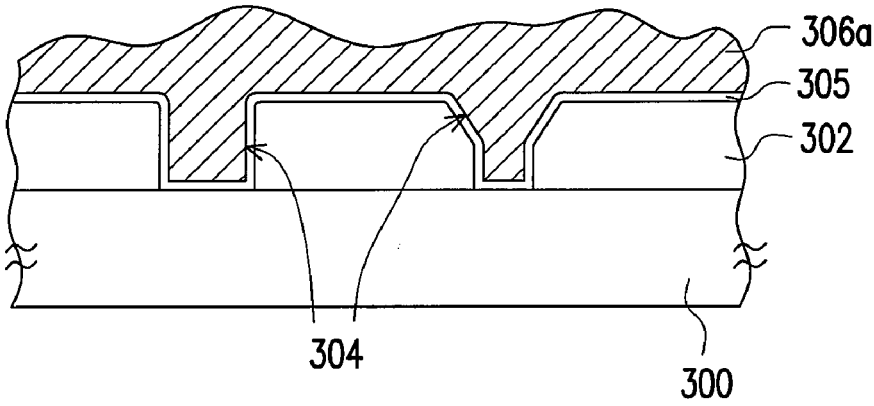

Referring to FIGS. 3A and 3B, the polishing liquid 312 is provided to the polishing pad 314. Polishing toward the conductive layer 306 lasts a first period T1 with the assistance of the polishing liquid 312 and the polishing pad 314, and a conductive layer 306*a* is obtained.

Figure 3C:
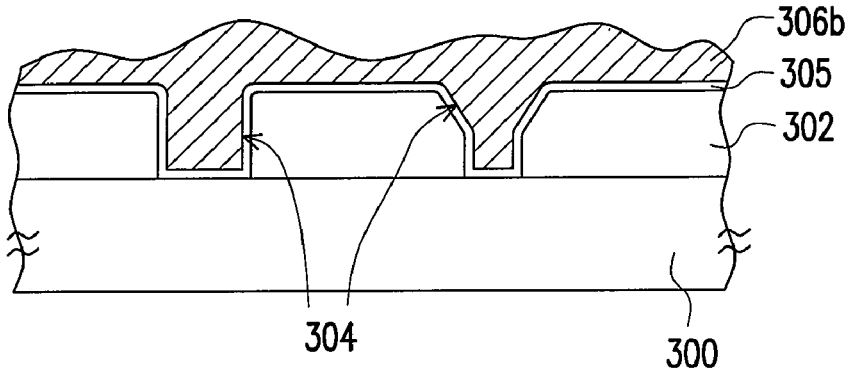

Referring to FIG. 3C, the supply of the polishing liquid 312 is ceased but the polishing of the conductive layer 306*a* is remained for a second period T2 along with the polishing pad 314, to form a conductive layer 306*b*.

Figure 3D:
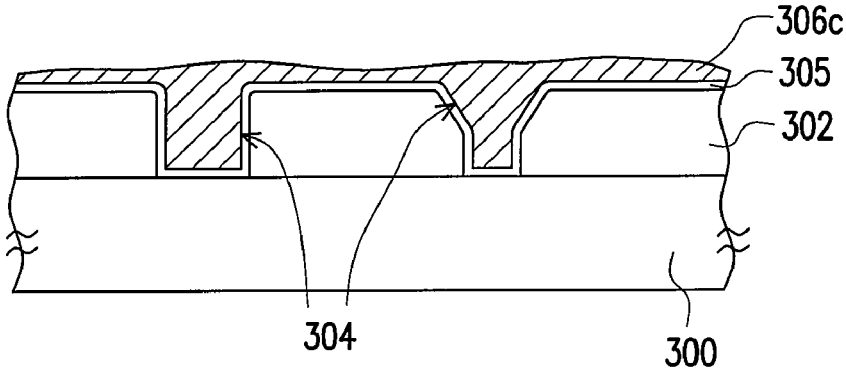

Referring to FIG. 3D, the supply of the polishing liquid 312 is restored (i.e. begin the polishing liquid supply) and the conductive layer 306*b* is polished for a third period T3 with the polishing liquid 312 and the polishing pad 314, to form a conductive layer 306*c*.

Figure 3E:
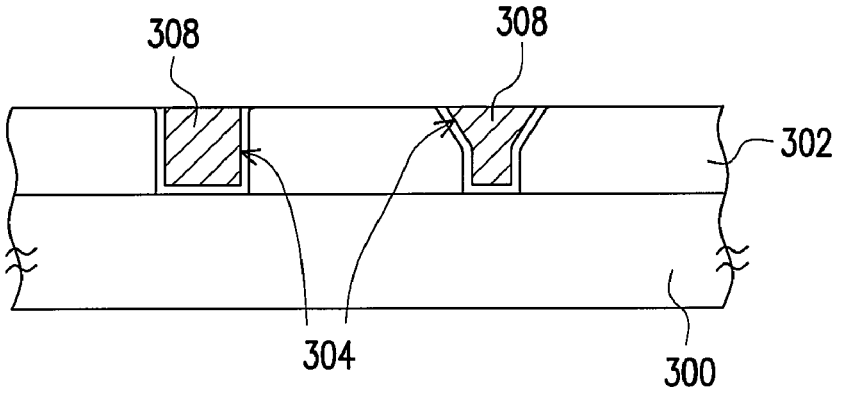

Subsequently, the steps as shown in FIGS. 3C to 3D are repeated for a few times, until the conductive layer 306*c* over the dielectric layer 302 is completely removed and an interconnect 308 is formed (FIG. 3E).

Although the preferred embodiment describes the polishing process for forming the metal interconnect structures, the supply method of this invention should not be limited to fabricate the described structures, but can be applied to fabricate the shallow trench isolation structures, inter-layer dielectric layers, damascene structures and to planarize other advanced devices such as microelectronics or planar displays.

The polishing liquid supply method of the present invention can periodically cease the supply of the polishing liquid, and the ceased period or cycle can be adjusted depending on the requirements of the fabrication processes or conditions of the polishing pad and the dresser. Therefore, not only the wastage of the polishing liquid can be reduced and the production costs can be lower, but also satisfactory polishing performances can be achieved.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A method of supplying a polishing liquid, comprising the steps to:

(a) provide a wafer having a material layer thereon;

(b) perform a polishing process to the material layer of the wafer by providing at least a polishing liquid and polishing for a first period T1, wherein the material layer is in contact with a polishing pad on a platen during polishing;

(c) stop supplying the polishing liquid and keep polishing for a second period T2;

(d) provide the polishing liquid and keep polishing for a third period T3; and (e) repeat the steps of (c) to (d) until reaching an polishing endpoint of the polishing process, wherein a duration of the polishing process is T0, T0=T1+n×(T2+T3), and n represents a total number of repeating the steps of (c) to (d), n is an integer larger than 0, T1 is larger than T2 and T3, and T1 is at least larger than 10% of T0.

2. The method of claim 1, wherein T1 is about 50% of T0.

3. The method of claim 1, wherein T2 is about 0.5% of T0 to about 7.5% of T0.

4. The method of claim 1, wherein T1 is about 52% of T0, T2 is about 1% of T0, T3 is about 11% of T0 and n=4.

5. The method of claim 1, wherein T1 is about 49% of T0, T2 is about 2% of T0, T3 is about 15% of T0 and n=3.

6. The method of claim 1, wherein T1 is about 49% of T0, T2 is about 3% of T0, T3 is about 14% of T0 and n=3.

7. The method of claim 1, wherein the material layer comprises at least a metal layer.

8. The method of claim 1, wherein the material layer comprises at least a dielectric insulating layer.

9. The method of claim 1, wherein T0 is between about 1~200 seconds.

10. The method of claim 1, wherein T2 is positively correlated to the remained life time of the polishing pad.

11. The method of claim 1, further comprising using a dresser to condition the polishing pad.

12. The method of claim 11, wherein T2 is positively correlated to the remained life time of the dresser.

13. The method of claim 1, wherein T2 is adjustable by on-line monitoring in real time.

14. The method of claim 1, wherein the platen has a centripetal acceleration larger or equal to about 20 ft/sec$^2$.

* * * * *